US005533827A

United States Patent [19]

Scheiwiller

[11] Patent Number: 5,533,827

[45] Date of Patent: Jul. 9, 1996

[54] PAVING STONE CONSTRUCTION SET

[76] Inventor: René Scheiwiller, Postfach 266, 6052, Hergiswil, Switzerland

[21] Appl. No.: 146,173

[22] PCT Filed: Mar. 5, 1993

[86] PCT No.: PCT/EP93/00507

§ 371 Date: Nov. 9, 1993

§ 102(e) Date: Nov. 9, 1993

[87] PCT Pub. No.: WO93/18232

PCT Pub. Date: Sep. 16, 1993

[30] Foreign Application Priority Data

Mar. 11, 1992 [DE] Germany ..... 42 07 735.4

[51] Int. Cl.[6] ..... E01C 5/06

[52] U.S. Cl. ..... 404/38; 404/42

[58] Field of Search ..... 404/34, 35, 37, 404/38, 39, 41, 42

[56] References Cited

U.S. PATENT DOCUMENTS

| | | | |
|---|---|---|---|
| 4,445,802 | 5/1984 | Lööv . | |
| 4,496,266 | 1/1985 | Ruckstuhl | 404/38 X |
| 4,572,699 | 2/1986 | Rinninger | 404/42 |
| 4,792,257 | 12/1988 | Rinninger | 404/42 X |
| 4,907,909 | 3/1990 | Ruckstuhl . | |
| 5,028,167 | 7/1991 | Scheiwiller | 404/41 |
| 5,137,392 | 8/1992 | McCoy | 404/42 |
| 5,186,574 | 2/1993 | Tavares | 404/42 X |

FOREIGN PATENT DOCUMENTS

| | | | |
|---|---|---|---|
| 0185861B1 | 7/1986 | European Pat. Off. . | |
| 0227144B1 | 7/1987 | European Pat. Off. . | |
| 0274344A1 | 7/1988 | European Pat. Off. . | |
| 2615876 | 12/1988 | France | 404/42 |
| G8418436.1 | 8/1984 | Germany . | |
| 3322090A1 | 12/1984 | Germany . | |
| G8617086.4 | 1/1987 | Germany . | |
| 189904 | 7/1992 | Japan | 404/34 |

*Primary Examiner*—David J. Bagnell
*Assistant Examiner*—James A. Lisehora
*Attorney, Agent, or Firm*—Spencer & Frank

[57] ABSTRACT

A concrete paving stone adapted to be disposed in circular and elongate paving configurations. The paving stone includes at least two side walls and a substantially planar upper face, each of the side walls being an arched side wall and including an elevated face at a center region thereof which comprises an abutting surface and two associated wedge surfaces adjoining the abutting surface on both sides thereof. The associated wedge surfaces extend from the abutting surface to an associated arched side wall. The elevated face further extends across a substantial portion of a length of the associated arched side wall and is effective for creating a fixed abutment between adjoining arched side walls of adjoining paving stones in a paving configuration.

14 Claims, 6 Drawing Sheets

Fig 1a
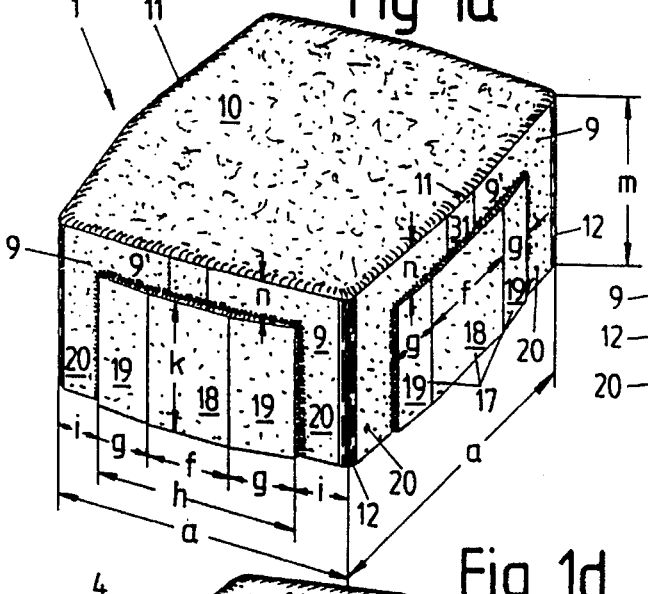
Fig 1b
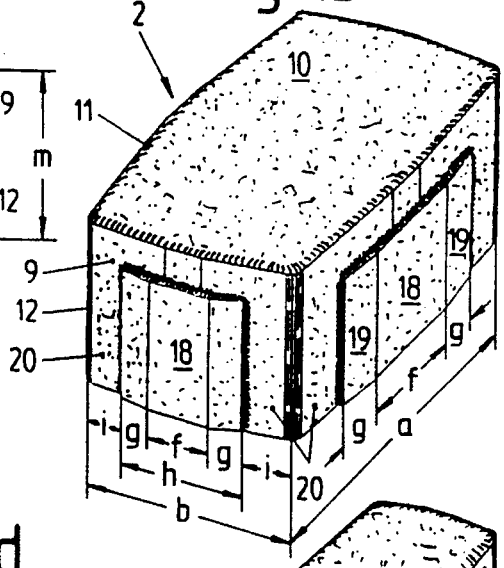
Fig 1d
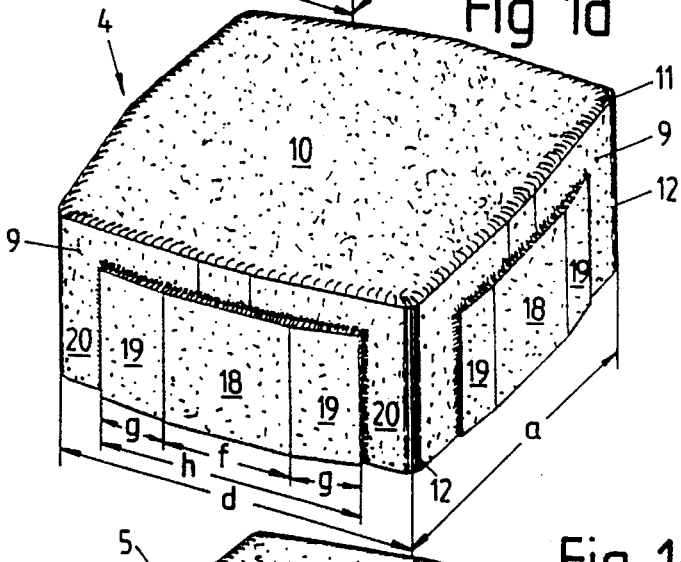
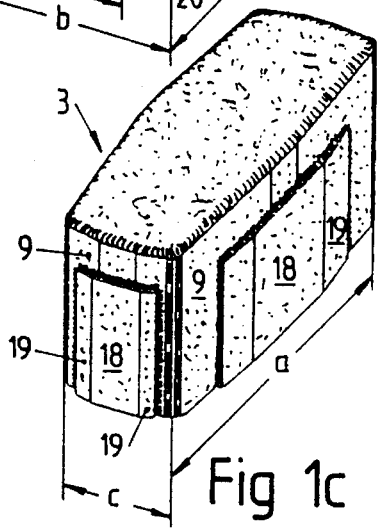
Fig 1c
Fig 1e
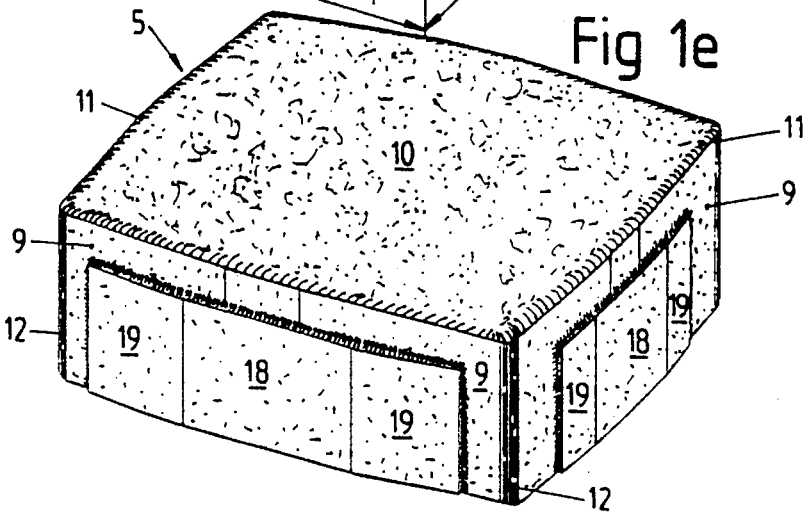

Fig 2a
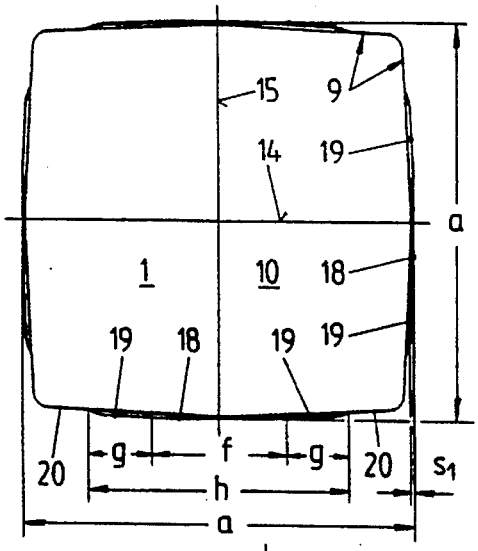
Fig2b
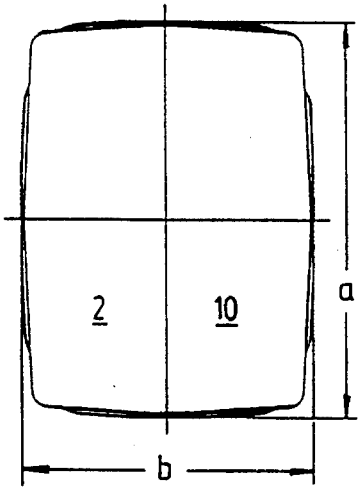
Fig 2c
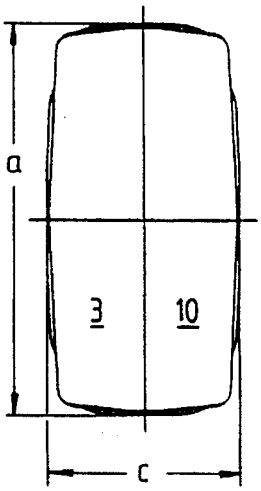
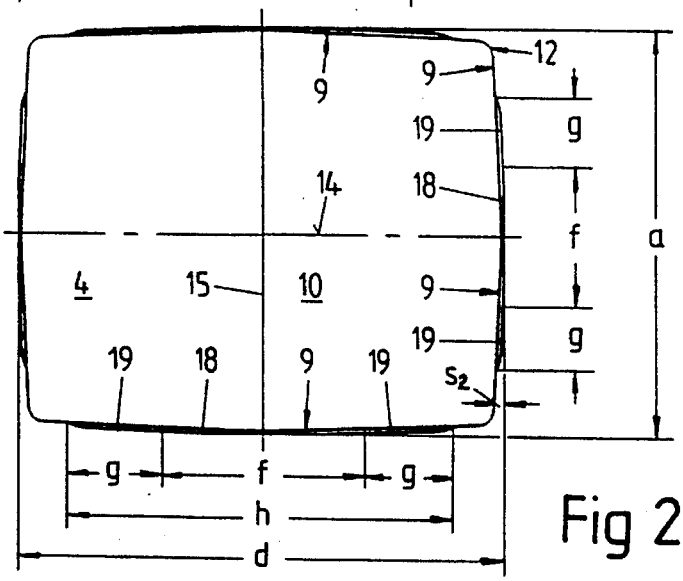
Fig 2d
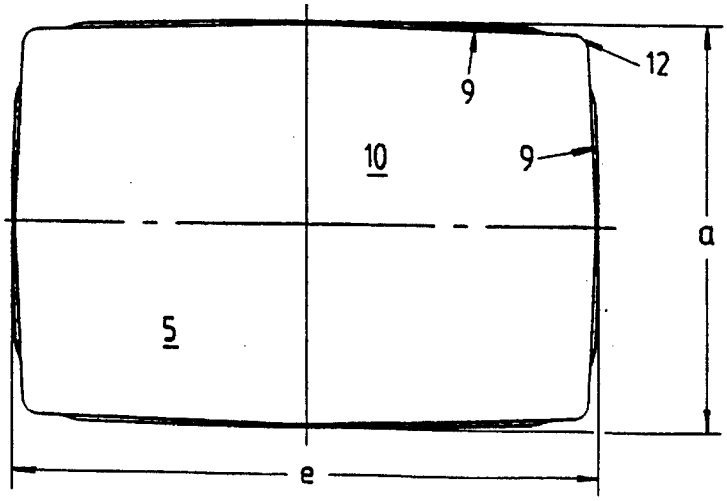
Fig 2e

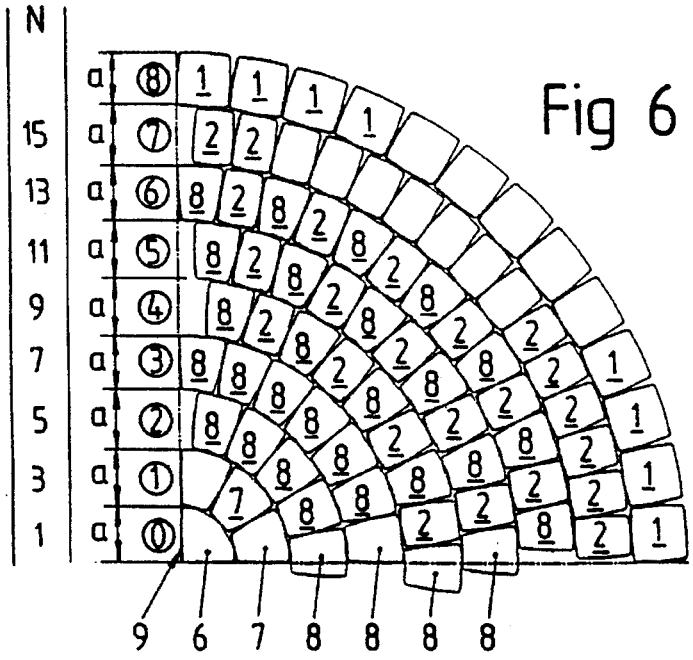
Fig 6
Fig 7
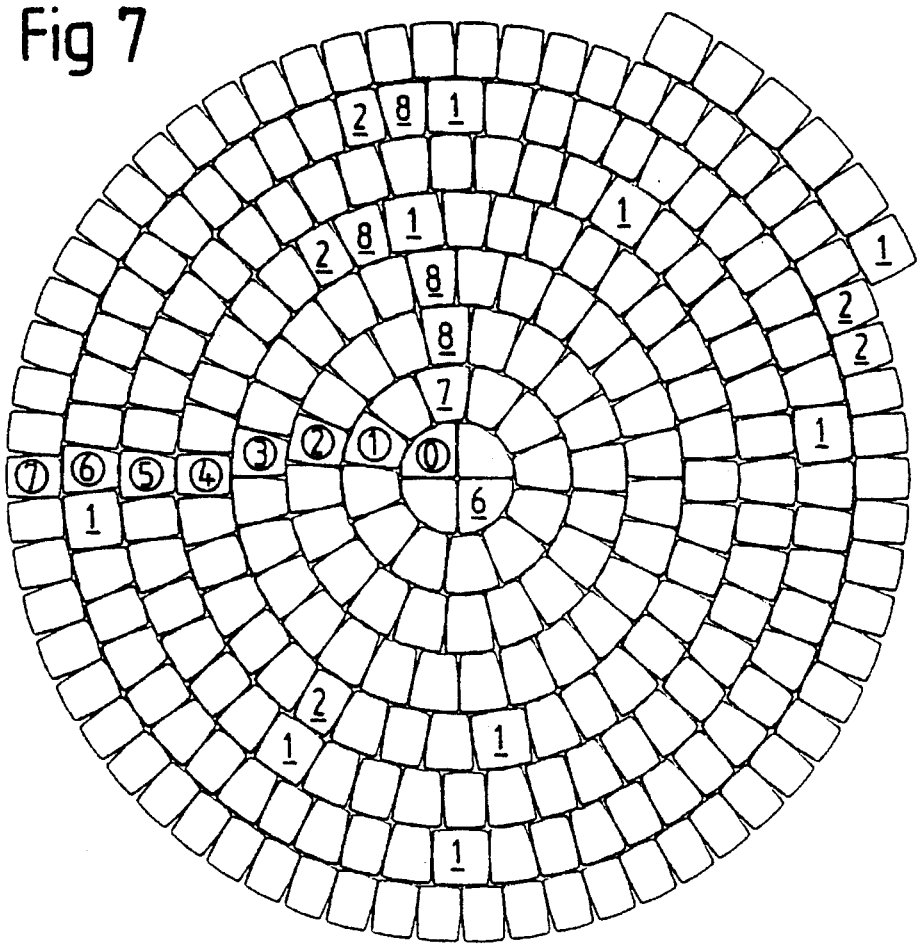

Fig 8
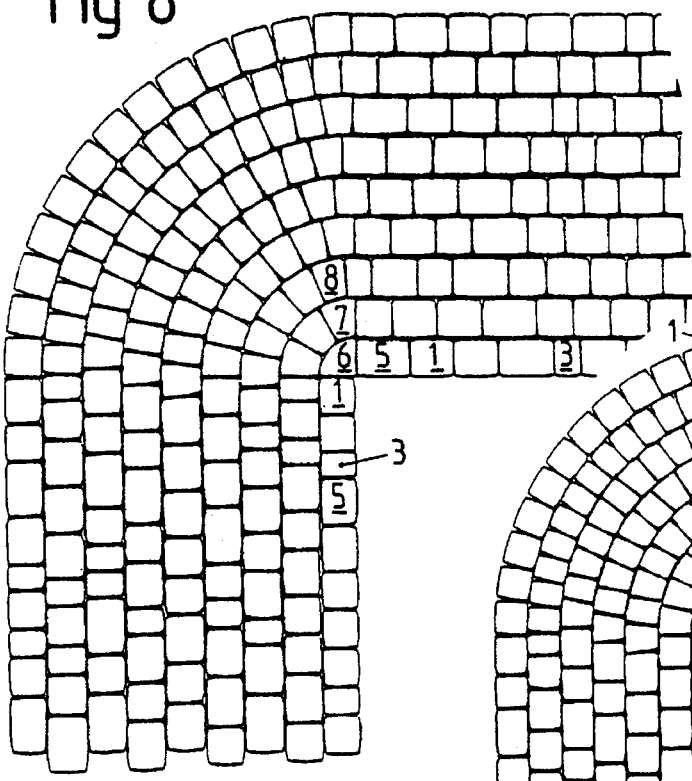
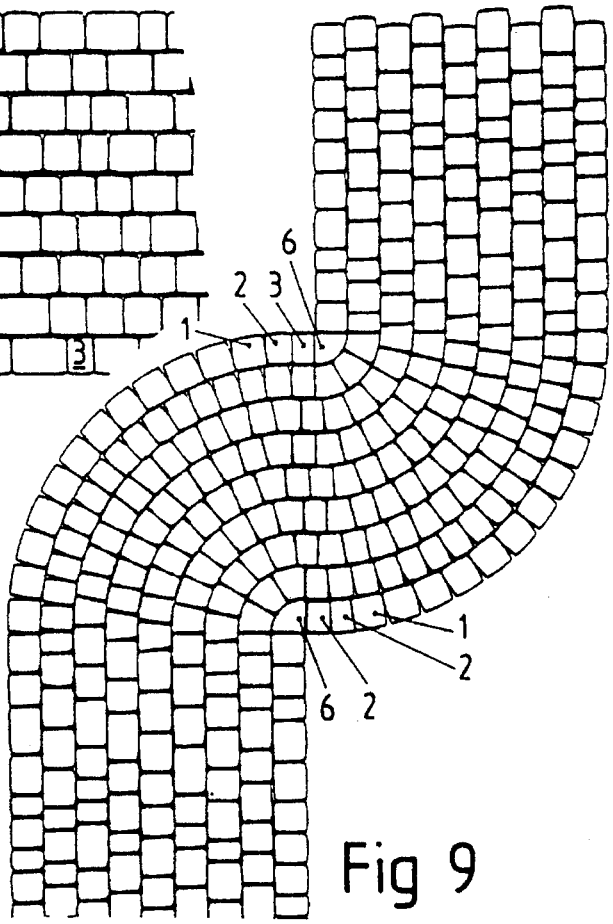
Fig 9
Fig 10
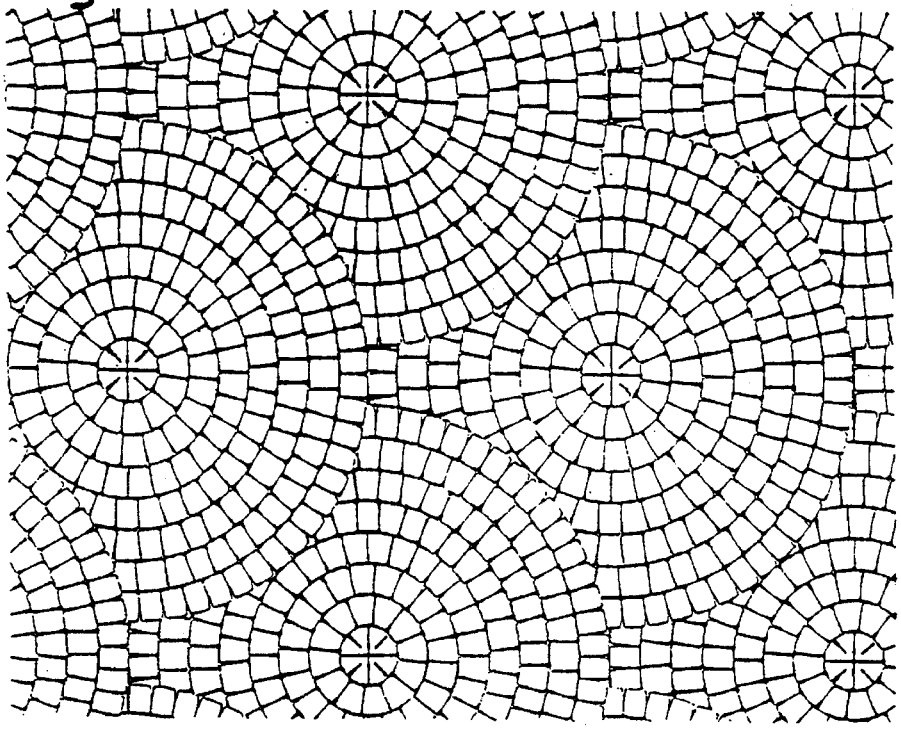

PAVING STONE CONSTRUCTION SET

FIELD OF THE INVENTION

The invention relates to a paving stone construction set including cuboidal paving stones and arcuate paving stones adapted to form elongate and circular paving configurations.

BACKGROUND OF THE INVENTION

Paving stone construction sets with various sizes of paving stones are adequately known. EP 0 185 861 B1 discloses, for example, a paving stone construction set which has five different stone shapes in matching sizes, which serve for laying certain patterns. On account of their square or rectangular outline, these paving stones serve, just like the paving stones from German utility model 84 18 436, for laying surface areas in a so-called stretching bond. As can be seen from FIG. 2 of the said utility model, the stones are in that case arranged offset with respect to one another in adjacent rows, the stone width partly being kept in a grid dimension.

If it is wished also to lay curves with these stone shapes, so-called curve stones or wedge stones serve for this purpose, as are shown for example in German utility model 86 17 086 in German Offenlegungsschrift 33 22 090. In utility model 86 17 086, a heptagonal center stone is used, around which the first row of wedge stones is laid. Instead of such a polygonal stone, if appropriate a normal square stone or rectangular stone may also be used.

When laying relatively large circular shapes, as from a certain radius use is made not only of wedge stones but also of rectangular stones or square stones, which however form between them radially outwardly opening gaps. These opening interspaces between the stones are larger in the case of stone shapes with planar side walls than in the case of stone shapes with convex side walls. Stone shapes with convex or arched side walls can be pushed closer together if in an oblique position at the radially inner edge, so that the gap between the stones is altogether less obtrusive.

The use of stone shapes with straight or planar side faces accordingly has the disadvantage that, if square or rectangular cross-sections are used in a circular arrangement, greatly opening gaps occur between the stones. This can be clearly seen, for example, in FIG. 11 in EP 0 227 144.

The use of planar side faces has the advantage, however, that when laying the stones in a straight stretching bond, the side faces can be laid touching one another, so that a lateral hold of the stone shapes against one another is ensured. Furthermore, in the case of planar side faces, smallest gaps between the stones can be set when laying in a straight line. Finally, stones with planar side faces can also be transported and stacked more easily.

In order to ensure a certain minimum spacing between the stones with planar side faces, lateral protuberances or elevations have become known, as disclosed by FIGS. 1 to 3 of EP 0 227 144. These protuberances have, however, in turn the disadvantage that, just like the stone shapes with arched side faces, they do not permit or only poorly permit stacking of the stones, since the stones lie against one another at their side flanks in punctiform or linear contact.

SUMMARY OF THE INVENTION

The invention is based on the object of proposing a paving stone construction set which does not have the said disadvantages and which provides in particular a set of stones with which both circular representations and representations in a stretching bond are possible. At the same time, the set of stones is to comprise individual stones which can be stacked very well for transportation. Furthermore, no gaps between the individual stones are to be possible, even when laying curves or laying circles. Finally, the set of stones is to be equipped with stones which give a pleasing appearance at the same time as meeting the desired technical requirements.

This object is achieved according to the invention on the basis of a set of stones where both cuboidal paving stones and arcuate paving stones can be used to create an elongate paving configuration or at least one quarter-circular paving configuration. The arcuate paving stones comprise three types of paving stones: a quarter-circle paving stone, inner circle stones having radial side walls subtending an angle of about 30°, and outer circle stones having radial side walls subtending an angle of about 15°. The above set of paving stones allows the formation of at least one quarter-circular paving configuration composed of concentric radial rows which comprise: an inner circle radial row consisting exclusively of inner circle stones and disposed radially outwardly from and adjacent to the quarter-circle paving stone; and at least one outer circle radial row consisting exclusively of outer circle stones and disposed radially outwardly from and adjacent to one of the inner circle radial row and an immediately preceding outer circle radial row. Further details essential for the invention are specified in the following subclaims.

The object of the present invention is to create a pleasing, visually attractive basic shape of the individual paving stones by the visual effect of arched, i.e. convex side faces, the paving stones behaving like paving stones with planar side faces during transportation and when laying. At the same time, the advantages of lateral arching, i.e. the possibility of tilting the individual stones with respect to one another, as allowed by the arched side faces, is nevertheless retained.

By these measures, together with the selection of certain stone sizes, it is also possible to lay circular surface areas which ensure a high degree of respective side support of the individual stones against one another by planar abutting faces. This applies both in the straight laying pattern and in the curved laying pattern. Furthermore, the stone sizes and the stone shapes in the construction set are matched to one another in such a way that a high degree of visual attractiveness is achieved, which applies in particular in the case of curve laying.

Further details and advantages of the invention are represented in the following description in conjunction with the drawings.

BRIEF DESCRIPTION OF THE DRAWINGS

FIGS. 1*a*–1*e* show a perspective view of the set of paving

FIGS. 2*a*–2*e* show a top plan view of the paving stones according to FIGS. 1*a*–1*e*, FIGS. 3*a*–3*c* show a perspective view of three different circle stones.

FIG. 6 shows a top plan view of the laying of a quarter circle, FIG. 7 shows a top plan view of a laying example of a complete circle, FIG. 8 shows a top plan view of a laying example of an L pattern, FIG. 9 shows a top plan view of a laying example of an S pattern and FIG. 10 shows a top plan view of a laying example of several circular shapes one in the other.

DETAILED DESCRIPTION OF THE INVENTION

Figure 3A:
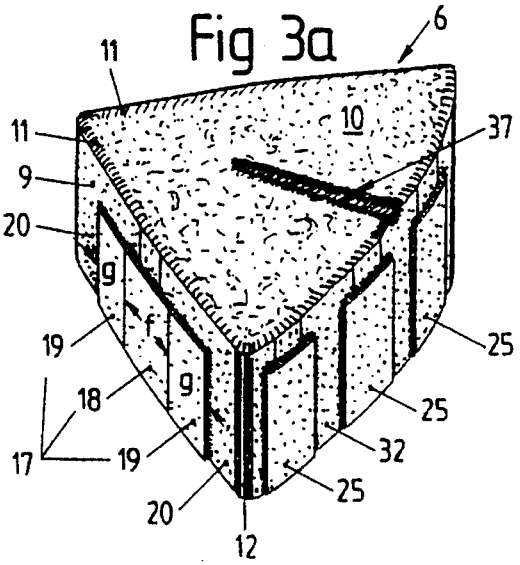
Figure 3B:
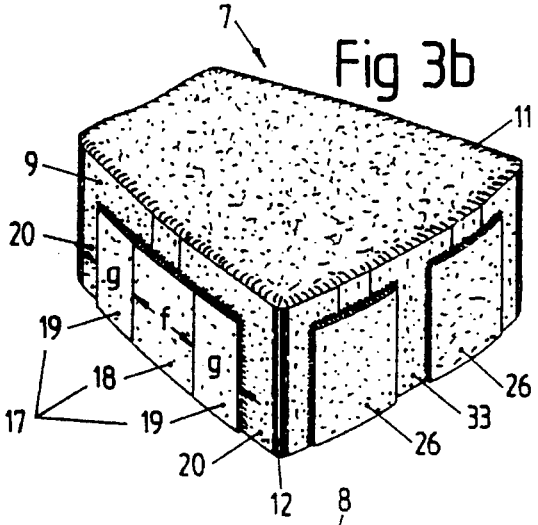
Figure 3C:
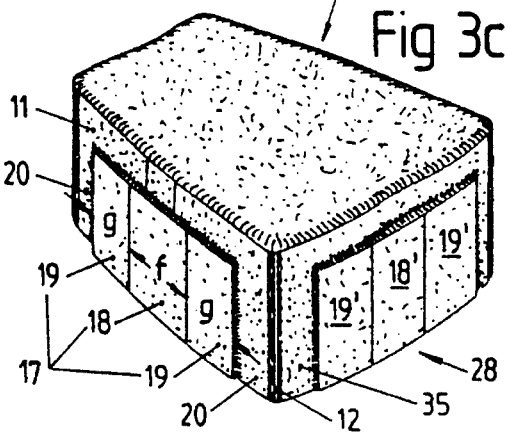

The paving stone construction set according to the present invention comprises the five cuboidal paving stones 1 to 5 shown in FIGS. 1*a* to 1*e*, and also the three curve stones or circle stones 6 to 8 represented in FIGS. 3*a* to 3*c*.

Figure 4A:
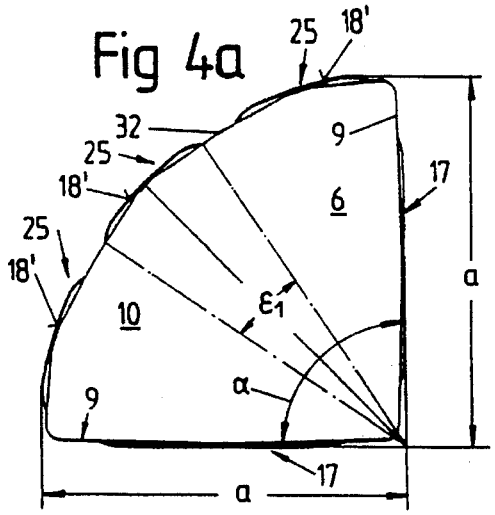
FIGS. 4*a*–4*c* show a top plan view of the circle stones according to FIGS. 3*a*–3*c*
Figure 4B:
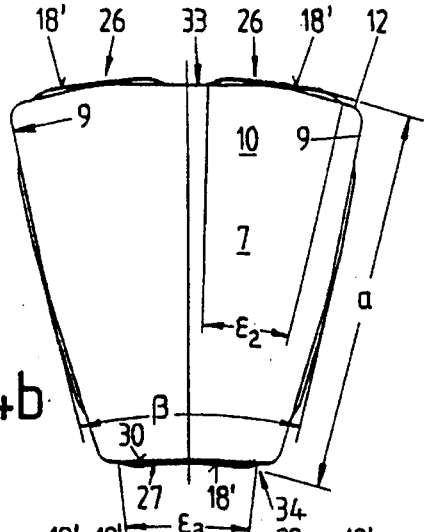
Figure 4C:
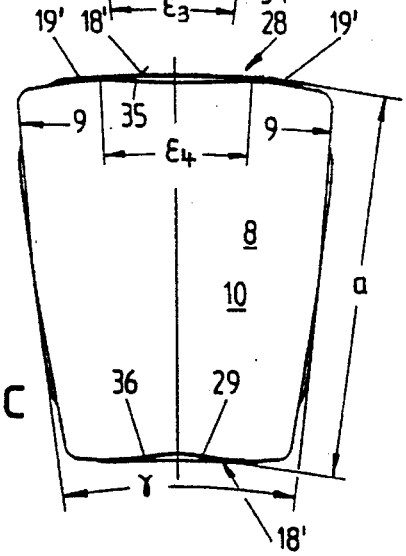

In FIGS. 2*a* to 2*e*, the plan views of the stones 1 to 5 according to FIGS. 1*a* to 1*e* are shown, in FIGS. 4*a* to 4*c* the plan views of the stones 6 to 8 according to FIGS. 3*a* to 3*c* are shown.

The paving stone construction set is built up in a basic grid dimension of the length a≈12.5 cm. The cross-sectionally square 1/1 stone with the side length a, represented in FIGS. 1*a* and 2*a*, serves as the basic stone. All modified stone shapes according to FIGS. 1*b* to 1*e* and 2*b* to 2*e* as rectangular stones also according to FIGS. 3 and 4 as circle stones have at least one side face in the grid dimension a. This dimension is drawn in the corresponding figures.

The cuboidal stones according to FIGS. 1 and 2 are subdivided in the 1/4 unit dimension. The stone according to FIGS. 1*b*, 2*b* is accordingly a 3/4 stone with the side length b=3/4 a. The paving stone 3 represented in FIGS. 1*c*, 2*c* is a 1/2 stone with the side length c=1/2a. The paving stone 4 in FIGS. 1*d* and 2*d* is a 5/4 stone with the side length d=5/4 a. The paving stone 5 represented in FIGS. 1*e*, 2*e* is a 1 1/2 stone with the stone length e=6/4 a.

The circle stone 6 represented in FIGS. 3*a*, 4*a* is designed as a 90° stone or a wedge-shaped quarter-circle paving stone, with side length a and the enclosed angle $\alpha \approx 90°$. Arcuate paving stones 7 and 8 are also shown in FIGS. 3/4 and 3*b*/4*b*, respectively. Inner circle stone 7 represented in FIGS. 3*b*, 4*b* likewise has a side length a and an enclosed angle $\beta \approx 30°$ subtended by its radial side walls. Outer circle stone 8 represented in FIGS. 3*c*, 4*c* has a side length a and an enclosed angle $\gamma \approx 15°$ subtended by its radical side walls.

The paving stone construction set with the cuboidal paving stones 1 to 5 and the curve stones 6 to 8 has a basic shape of the paving stones which have arched or convex side walls 9, as can be seen from FIGS. 2*a* to 2*e* and 4*a* to 4*c* in plan view. Such arched side walls are known, for example, from utility model 86 10 102, FIG. 5. This known stone shape is also represented in FIG. 5*b* of the present application as a plan view of a stone shape, in contrast to the known stone shape according to FIG. 5*c* with planar side faces.

The upper, walk-on face 10 of the paving stones 1 to 8 is designed as a planar or, at most, slightly convex surface. The transitional face 11 between the upper face 10 and the arched side walls 9 is designed as a uniformly peripheral rounded-off phase 11. This is represented by the short peripheral lines indicated.

The perpendicular edges 12 between the arched side walls 9 are designed as rounded-off edges.

Figure 5A:
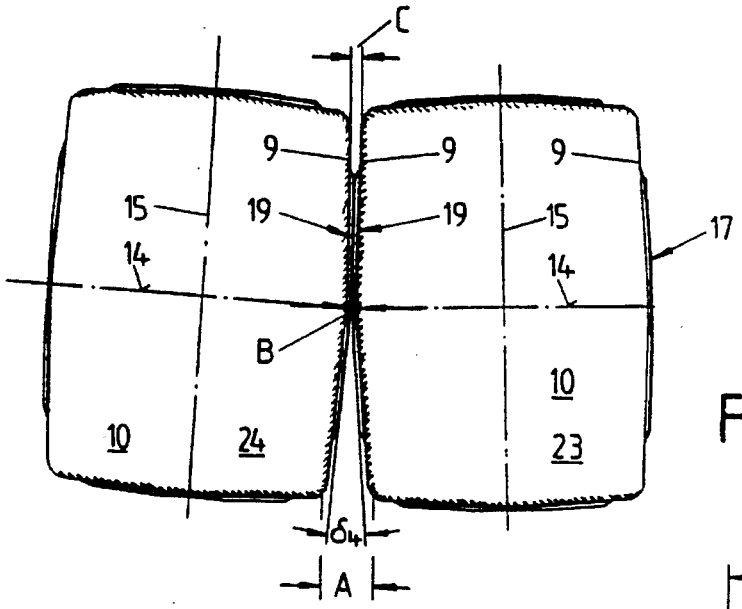
FIGS. 5*a*–5*c* show three exemplary top plan views of a tilted laying of various stone shapes.
Figure 5B:
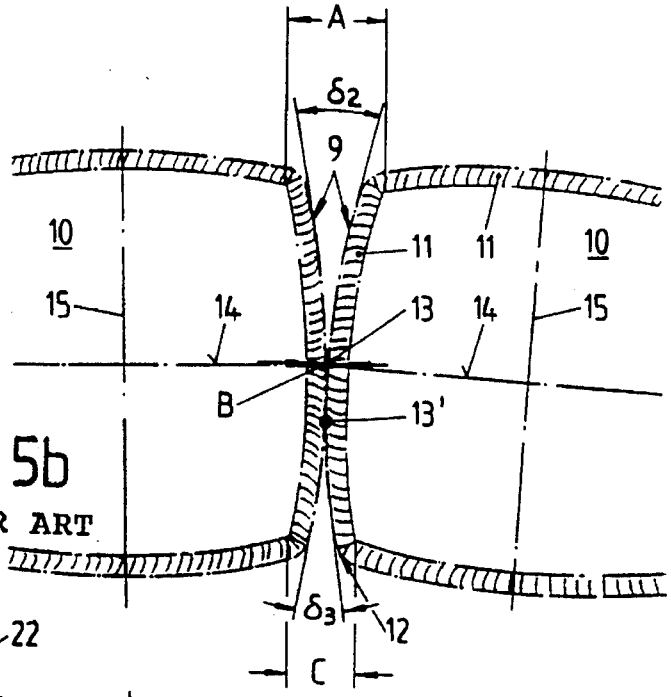
Fig 5b PRIOR ART

The stone shape described above produces a paving stone such as that represented in principle in FIG. 5*b*. If such known stones are laid abuttingly next to one another, they touch along a perpendicular line, which in FIG. 5*b* in plan view appears as point 13 at the intersection of the lines of symmetry 14. When laying these stones, therefore, an uneven stretching bond is produced, since the lines of longitudinal symmetry 14 often do not lie in a line but form an obtuse angle. The axes of symmetry 14, 15 are therefore not parallel to each other, as indicated in FIG. 5*b*.

Figure 5C:
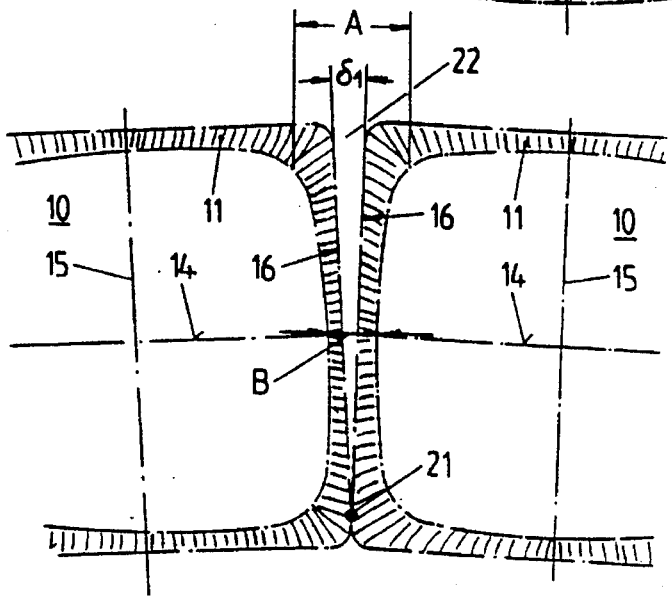
Fig 5c PRIOR ART

If the known paving stone according to FIG. 5*c* with planar side walls 16 is laid in a straight stretching bond, the side walls generally lie flat against one another, unless they are laid staggered or with a joint. This results in advantages, in particular when transporting such stones.

In order to obtain a planar abutting face on the side wall even is the case of an arched paving stone with convex side walls 9 of the paving stones 1 to 8, the paving stones according to the invention have on their side walls polygonal bearing faces or abutting elevated faces. In the case of the stones 1 to 5, these polygon faces 17 on all the arched side walls 9 comprise an axially parallel abutting face or surface 18 with the length f, and wedge faces or surface 19 with the lengths g adjoining face 18 on both sides thereof. The overall length of the polygon face 17, comprising the subregions 18, 19, is denoted by h.

The overall length h of the polygon face 17 depends on the length of the arched side wall 9. It extends over virtually or at least up to about 75% of the respective width of the arched side wall 9. To the left and right of the wedge faces 19 there remains a side wall part 20 of the side wall 9. This wall region has a length i. This remaining residual length 20 of the respective side wall a to e serves for better drainage in the case of paving stones laid abuttingly by means of the faces 18.

The abutting faces 18 parallel to the axes of symmetry 14, 15 accordingly serve as planar lateral abutting faces between the individual paving stones, the width f of this abutting face taking up approximately ⅓ of the overall length of the respective side wall 9. The remaining ⅔ of the overall length are taken up by the two wedge faces 19 and the wall sections 20. This results in a highly flush surface-area contact between the stones both during laying and during transportation of the stones.

The depth or thickness s, by which the wall section 18 projects laterally beyond the arched wall 9 in the region of the axes of symmetry 14, 15, amounts to a first depth $s_1 \approx 1.5$ mm. On account of the arching of the side face 9, the polygon face widens in spite of the wedge-shaped deviation with the face sections 19 to a second depth $s_2 \approx 2.5$ mm. The polygon face 17, comprising the face sections 18, 19, may however also run largely parallel to the arched side wall 9, although there are planar face sections 18, 19 present.

The paving stones according to FIGS. 1 and 2 have in principle on their arched side walls 9 the elevating polygon faces 17, comprising the face sections 18, 19. The corresponding dimensioning is drawn in by way of example only in some stone shapes. Faces 17 are shown as being symmetrical with respect to a vertical centerline of the associated side wall.

The height k of all the polygon faces 17 likewise extends over at least 75% of the uniform overall height m of all the paving stones. The top remaining residual dimension n with the face section or arched wall part 9' serves for concealing the polygon face 17 brought to bear in the laid state, so that, seen from above, the paving stones in principle give only the appearance of arched side faces 9.

Above the face 18 there is symmetrically arranged a further flattened-off face or planar surface 31 in a center region the face section 9', the width of which is, however, only about ⅓ of the width g of the abutting face.

The planar bearing face 18 has, furthermore, the task of forming a natural spacer between the stones and consequently of forming a natural joint. Such joint formers as bearing faces are known per se from EP 0 227 144. However, they either extend over the entire side face or they are formed only by individual rounded-off protuberances.

The curve or circle stones 7 to 9 according to FIGS. 3*a* to 3*c* and 4*a* to 4*c* do not differ from the previously described cuboidal paving stones 1 to 5 in their basic design with respect to the arched side walls 9 with correspondingly attached polygon faces or radially protruding abutting face sections 17, comprising the abutting faces 18 and wedge faces 19. The same applies to the remaining design of the curve stones 6 to 8 with planar upper face 10, rounded-off transitional face 11 and rounded-off perpendicular edges 12. The arches side faces 9 in the basic grid dimension a have in principle a shaping similar to the 1/1 paving stone 1 according to FIGS. 1*a* and 2*a*. You are referred to the corresponding description of the side walls.

The configuration of the polygon face 17 with planar side face 18 and wedge faces 19 is suitable in particular for producing angular arrangements in the case of a circular or arcuate laying of the paving stones. For this purpose, you are referred to the representations of FIGS. 5 to 7.

As mentioned in the introductory part of the description, paving stones with rectangular or square cross-section are sometimes used also for laying curved laying patterns. According to the representation in FIGS. 10 and 11 EP 0 227 144, and also a corresponding representation in FIG. 5*c* of the present application, a relatively great aperture angle $\delta_1$ is produced in the case of a paving stone with planar side walls 16 even when there is a slight tilting of the intersections of the axes of symmetry 14, 15. In this case, the abutting stones touch with linear contact, the plan view of which shows point 21. Apart from the fact that this gives a less attractive appearance of the laid surface area, there occurs on the opposite side a large interspace 22, which may to some extent have a highly adverse effect on the suitability of the surface area for walking on. The linear contact face 21 may also result in the stone being damaged, in particular in the edge region. Such paving stones with planar side walls 16 are therefore very poorly suited for incorporation in a curved layout. This can also be seen from FIGS. 10 and 11 of EP 0 227 144.

If a stone shape with an arched, i.e. rounded-off side wall according to the representation in FIG. 5*b* is chosen, the upper aperture angle $\delta_2$ on account of the convex side wall is greater than in the case of the representation according to FIG. 5*c* even from a slight tilting of the intersection of the axes 14, 15. Here too there is a linear contact of the stones at the point 13', i.e. in an off-center position. If the axes of symmetry 14, 15 of the two stones is tilted even further apart, the upper angle $\delta_2$ increases still further, with a simultaneous decrease in the lower angle $\delta_3$.

The effective walk-on upper face 10 is also determined by the degree of rounding off of the transitional face 11. For instance, the stone shape in FIG. 5*c* with the planar side walls 16 exhibits in the corner regions a greater interruption A+B of the upper tread face due to the greater phase formation of the transitional faces 11. In FIG. 5*b*, the interruption A+B+C of the tread face amounts to smaller values, seen in absolute terms. This is a consequence of the smaller phase formation of the transitional face 11.

In FIG. 5*a* a paving stone arrangement according to the present invention is shown in a tilted position, i.e. the axes of symmetry 15 form an angle with respect to each other. On account of the additional polygon face 17, even in an angular position in the region of the wedge faces 19 there is flush surface-area contact of the two stones 23, 24. If the wedge face 19 is itself subdivided in turn into polygonal sections, different angle settings of the tilted stones can also be readily created, with an always flush surface-area abutting face between the respective stones. The interruption A+B+C of the tread face 10 is reduced on account of this arrangement with the polygon face 17 to a minimal value, i.e. the gap between the stones can be kept very small. The same applies to the aperture angle $\delta_4$.

Accordingly, with the paving stone according to the invention, a flush surface-area bearing or abutting face of the paving stones with respect to one another can be achieved in broad limits even in the case of curve laying. At the same time, the visually advantageous arched side walls 9 are in principle retained in their shaping.

In FIGS. 6 and 7, the arrangement of the various paving stones is represented in the case of circular laying and is explained below. In this case, the full circle in FIG. 7 represents in principle a combination of the quarter circle according to FIG. 6.

For forming a quarter circle as shown in the representation according to FIG. 6 with the paving stone construction set according to the invention, first of all eight different rows are formed, which are denoted in FIG. 6 by 1 to 8 in the circle. Since the quarter circle covers an angle of 90°, first of all the 90° stone 6 according to the invention is provided as the center stone with "row 0". This stone is represented in more detail in FIGS. 3*a*, 4*a*. Accordingly, not only a normal square stone, but also a specially adapted 90° stone is used as the center stone.

All the following rows of the circle 1 to 7 up to a circle diameter of about 2.0 m are formed by an odd number "N" of individual stones. This produces an outstanding visual impression.

In the first row "1" (first circle segment), accordingly three "inner circle stones" 7 are provided with an aperture angle $\beta \approx 30°$, as is represented in FIGS. 3*b*, 4*b*. The use of three inner circle stones 7 covers an angle of arc of about 90°.

In the following row "2", five "outer circle stones" 8 are used, which have an aperture angle 15°. An optimization of this stone gives an aperture angle $\gamma = 15.25°$.

The stones are arranged offset with respect to the row "1", so that the joints of the respectively inner circle are at least partially covered.

The next row "3" is formed by seven outer circle stones 8. The following row "4" is formed by five outer circle stones 8 and four 3/4 stones 2, as is represented in FIGS. 1*b*, 2*b*. Already from the row "4", use is accordingly also made of cuboidal stones, which are set in a certain tilting inclination, for which purpose the lateral polygon faces 17 serve in particular.

In the row "5", six outer circle stones 8 and five 3/4 stones 2 are provided. In the following circle 6, seven outer circle stones 8 and six 3/4 stones 2 are provided.

In the following circle or the following row "7", no circle stones or curve stones are arranged, instead just fifteen 3/4 stones 2 next to one another. Up to the row 7, the sum N of the number of stones in each row is a successive odd number (see column "N" in FIG. 6). As from the following row "8", thirteen normal stones, i.e. 1/1 stones 1 are provided, as are represented in FIGS. 1*a*, 2*a*. All further rows which follow can be built up with this stone and in combination with other stones from the construction set.

All the rows of stones have the side length a as basic grid dimension. As can be seen from FIG. 6, the rows "2", "4" and "5" are offset with respect to one another in such a way that they project on one side beyond the 90° angle, which however compensates for itself in the case of a complete circle according to FIG. 7.

The representation of a circle according to FIG. 7 is made in principle of four quarter circles according to FIG. 6. According to the tabular list below, however, in the circles or rows "4 to 6" normal stones, i.e. 1/1 stones, are also used for a more pleasing visual representation of the circular pattern.

| | |
|---|---|
| | Quarter circle construction (FIG. 6) |
| Circle 0: 0 25 cm | one center stone 6 |
| Circle 1: 0 50 cm | three inner circle stones 7 |
| Circle 2: 0 75 cm | five outer circle stones 8 |
| Circle 3: 0 100 cm | seven outer circle stones 8 |
| Circle 4: 0 125 cm | five outer circle stones 8<br>four ¾ stones 2 |
| Circle 5: 0 150 cm | six outer circle stones 8<br>five ¾ stones 2 |
| Circle 6: 0 175 cm | seven outer circle stones 8<br>six ¾ stones 2 |
| Circle 7: 0 200 cm | fifteen ¾ stones 2 |
| Circle 8: 0 225 cm | thirteen normal stones 1 |
| | Circle construction (FIG. 7) |
| Circle 0: 0 25 cm | four center stones 6 |
| Circle 1: 0 50 cm | twelve inner circle stones 7 |
| Circle 2: 0 75 cm | twenty outer circle stones 8 |
| Circle 3: 0 100 cm | twenty-eight outer circle stones 8 |
| Circle 4: 0 125 cm | eighteen outer circle stones 8<br>sixteen ¾ stones 2<br>two normal stones 1 |
| Circle 5: 0 150 cm | twenty-two outer circle stones 8<br>twenty-two ¾ stones 2<br>two normal stones 1 |
| Circle 6: 0 175 cm | twenty-six outer circle stones 8<br>twenty-two ¾ stones 2<br>four normal stones 1 |
| Circle 7: 0 200 cm | sixty-two ¾ stones 1 |
| Circle 8: 0 225 cm | fifty-two normal stones 1 |

For laying circular shapes according to the representations in FIGS. 6 and 7, accordingly the 90° stone 6, the two circle or curve stones 7 and 8 and also the 3/4 stone 2 and the 1/1 stone 1 can be used. The further stones of the paving stone construction set, namely the 1/2 stone 3 and also the 5/4 stone 4 and the 1 1/2 stone 5 are used primarily for laying surface areas in a stretching bond.

Examples of combined laying are represented in FIGS. 8 and 9. FIG. 8 shows an L-shaped laying of the paving stones with a quarter circle according to FIG. 6 and also two surface areas in a stretching bond adjoining said quarter circle. FIG. 9 shows the placing together of two quarter circles according to FIG. 6 with two formations laid in a stretching bond adjoining said quarter circles.

In these figures, some of the stones as numbered according to FIGS. 1 to 3 are drawn in by way of example.

FIG. 10 shows a representation of circular shapes which merge one in the other.

According to the present invention, the advantages of the known paving stone with arched side walls are further developed to the extent that correct laying of the various stone shapes always with flush surface area contact instead of the previous linear contact is made possible. This purpose is served in particular by retaining the arched basic shape of the side walls with the attached polygonal faces 17, which form bearing faces or abutting faces and, in addition, also spacers for joint formation. In this case, the polygon face extends over the greater part of the respective side wall and consequently forms lateral abutting faces.

As can be seen from FIGS. 3*a* to 3*c* and also FIGS. 4*a* to 4*c*, the circle stones or curve stones 7 to 8 have also on their outer (circle stone 6) and on their inner (circle stone 7, 8) arc faces 32 to 36 additional face sections 25 to 29, which rise up from the convex side walls in a way similar to the polygon faces 17 of the cuboidal paving stones. In this case, these face sections 25 to 29 also form planar faces, which are designed in a way corresponding to the abutting face 18. In the case of the 90° stone 6, three symmetrically arranged face sections 25 are provided over the angle of 90° and in each case form planar abutting faces 18'. The angle space of these abutting faces is in each case about $\epsilon_1=20°$.

Similarly, the 30° circle stone 7 has two face sections 26 provided on the outer arc 33, with a planar abutting face 18'. The angle space corresponds to $\epsilon_2=10°$.

The face section 27, lying on the inner circle arc 30, of the circle stone 7 covers an angle space of $\epsilon_3=20°$. The attached face section 27 likewise has a largely planar abutting face 18'.

The circle stone 8 represented in FIGS. 3*c*, 4*c*, with an aperture angle $\gamma$, has on its outer arcuate face 35 the face section 28, which is constructed similarly to the polygon face 17 of the cuboidal stones. Accordingly, a central abutting face 18' and two wedge faces 19', which are attached laterally to said abutting face and extend largely over the entire arc 35, are provided. As can be seen from FIG. 4*c* in plan view of the circle stone 8, the central, planar abutting face 18' extends over a large angle space $\epsilon_4=\frac{1}{3}\gamma$. The two wedge faces 19' laterally adjoining thereto are largely designed as planar adjoining faces.

In the inner arc region 36 of the circle stone 8 there is the face section 29, which as planar abutting face 18' extends largely over the entire arc region.

The face sections 25 to 29 likewise serve as planar attaching faces and as spacers when laying the paving stones according to the invention. The same applies to transporting these paving stones, which with their planar attaching faces can easily be packaged and consequently transported.

In the case of the curve stones 6 to 8, the side length a of the respective side walls 9 is based on the degree of the tangent to the abutting faces 18'.

The 90° stone 6 has in its upper region a dummy joint 37, which gives the visual impression of a subdivision of the stone.

The invention is not restricted to the illustrative embodiments represented and described. Rather, it also comprises all further developments and improvements which can be carried out by a person skilled in the art within the scope of the idea according to the invention.

I claim:

1. A concrete paving stone adapted to be disposed in circular and elongate paving configurations, the paving stone including side walls and a substantially planar upper face, each of the side walls being an arched side wall and including an elevated face at a center region thereof which comprises an abutting surface and two associated wedge surfaces adjoining the abutting surface on both sides thereof, the associated wedge surfaces extending from the abutting surface to an associated arched side wall, the elevated face further extending across a substantial portion of a length of the associated arched side wall and being effective for creating a fixed abutment between an adjoining elevated face of an arched side wall of an adjoining paving stone in a paving configuration, whereby, in a tilted positioning of the paving stone with respect to the adjoining paving stone in the paving configuration, one of the two wedge surfaces is effective for creating a fixed abutment with an adjoining one of wedge surfaces of the adjoining paving stone.

2. A set of concrete paving stones for producing circular and elongate paving configurations, the set comprising a plurality of paving stones each according to claim 1, the set further being comprised of respective grids of the paving stones, with the grids having a common grid dimension a, wherein at least some of the paving stones comprise:

a plurality of cuboidal paving stones each having four side walls, the cuboidal paving stones including:

a plurality of basic stones each having both a length dimension and a width dimension corresponding to the common grid dimension a; and a plurality of three-quarter stones each having a length dimension corresponding to the common grid dimension a, and a width dimension corresponding to three quarters of the common grid dimension a;

arcuate paving stones each having two radial side walls, the two radial side walls each having a length dimension corresponding to the grid dimension a, the arcuate paving stones including:

at least one quarter-circle paving stone having an arcuate wall, and radial side walls which subtend an angle of about 90°;

inner circle stones each having an inner arcuate wall, an outer arcuate wall concentric with the inner arcuate wall, and radial side walls which subtend an angle of about 30°; and outer circle stones each having an inner arcuate wall, an outer arcuate wall concentric with the inner arcuate wall, and radial side walls which subtend an angle of about 15°;

the paving stones being adapted to be disposed in concentric radial rows to form at least one quarter-circular paving configuration, the radial rows further comprising:

a center radial row comprising the quarter-circle paving stone;

an inner circle radial row disposed radially outwardly from and adjacent to the center radial row and comprising exclusively inner circle stones disposed adjacent to one another at their radial side walls;

at least one outer circle radial row disposed radially outwardly from and adjacent to one of the inner circle radial row and an immediately preceding outer circle radial row, the at least one outer circle radial row comprising exclusively outer circle stones disposed adjacent to one another at their radial side walls; and subsequent radial rows comprising at least one of the cuboidal paving stones.

3. The set of paving stones according to claim 2, wherein the cuboidal paving stones further include:

a plurality of one-half paving stones each having a length dimension corresponding to the common grid dimension a, and a width dimension corresponding to one half of the common grid dimension a;

a plurality of one-and-one-half paving stones each having a length dimension corresponding to the common grid dimension a, and a width dimension corresponding to one and one half times the common grid dimension a.

4. The set of paving stones according to claim 2, wherein the cuboidal paving stones further include:

a plurality of five-fourths paving stones each having a length dimension corresponding to the common grid dimension a, and a width dimension corresponding to five fourths of the common grid dimension a.

5. The set of paving stones according to claim 2, wherein the outer arcuate wall and the inner arcuate wall of each of the inner circle stones and the outer circle stones include at least one radially protruding abutting face section thereon.

6. The set of paving stones according to claim 2, wherein the quarter-circle paving stone has an upper face including a dummy joint on an angle bisector thereof, the dummy joint comprising an incision.

7. The set of paving stones according to claim 2, wherein the radial rows comprise at least seven rows containing consecutively increasing odd numbers of stones starting from one and continuing up to at least thirteen.

8. The paving stones according to claim 1, wherein the abutting surface and the associated wedge surfaces are one of planar and slightly convex.

9. The paving stone according to claim 1, wherein each of the abutting surface and the associated wedge surfaces have a width, the width of the abutting surface being greater than the width of the associated wedge surfaces.

10. The paving stone according to claim 9, wherein each of the side walls includes an arched wall part disposed above an associated abutting surface, the arched wall part including a planar surface at a center region thereof.

11. The paving stone according to claim 1, wherein the elevated face is located at a distance from the upper face of an associated paving stone thereby forming a step at the associated side wall such that the step is not readily visible when the paving stones are laid in a paving configuration.

12. The paving stone according to claim 1, wherein the elevated face is symmetrical with respect to a vertical centerline of the associated side wall.

13. The paving stone according to claim 1, wherein the elevated face has, in a direction perpendicular to each of the side walls, a first depth defined between the abutting surface and the associated side wall at a vertical centerline of the associated side wall, and a second depth defined between the abutting surface and the associated side wall at a point at which the associated wedge surfaces join the associated side wall, the first depth measuring about 1 mm, and the second depth measuring about 2.5 mm.

14. The paving stone according to claim 1, wherein the elevated face has a width which is from about 0.7 to about 0.9 times the length of the associated side wall.

* * * * *